US010302278B2

(12) United States Patent
Lim et al.

(10) Patent No.: US 10,302,278 B2
(45) Date of Patent: May 28, 2019

(54) LED BULB WITH BACK-REFLECTING OPTIC

(71) Applicant: Cree, Inc., Durham, NC (US)

(72) Inventors: Jin Hong Lim, Cary, NC (US); Troy Trottier, Cary, NC (US); Kurt Wilcox, Libertyville, IL (US); John Roberts, Grand Rapids, MI (US)

(73) Assignee: Cree, Inc., Durham, NC (US)

( * ) Notice: Subject to any disclaimer, the term of this patent is extended or adjusted under 35 U.S.C. 154(b) by 401 days.

(21) Appl. No.: 14/682,707

(22) Filed: Apr. 9, 2015

(65) Prior Publication Data

US 2016/0298826 A1 Oct. 13, 2016

(51) Int. Cl.

| | |
|---|---|
| ***F21V 7/05*** | (2006.01) |
| ***F21V 7/09*** | (2006.01) |
| ***F21V 7/00*** | (2006.01) |
| ***F21V 5/04*** | (2006.01) |
| ***F21K 9/232*** | (2016.01) |
| ***F21K 9/69*** | (2016.01) |

(Continued)

(52) U.S. Cl.

CPC ..... *F21V 7/0091* (2013.01); *F21K 9/232* (2016.08); *F21K 9/69* (2016.08); *F21V 5/04* (2013.01); *F21V 7/05* (2013.01); *F21V 13/02* (2013.01); *F21Y 2105/00* (2013.01); *F21Y 2115/10* (2016.08)

(58) Field of Classification Search

CPC ..... F21V 5/045; F21V 7/09; F21V 7/0091; F21V 19/042; F21V 19/045; F21V 7/0016; F21V 7/0066; F21V 7/05; F21K 9/20; F21K 9/232; F21K 9/00; F21K 99/00; F21S 2/00

See application file for complete search history.

(56) References Cited

U.S. PATENT DOCUMENTS 3,581,162 A 5/1971 Wheatley
5,065,287 A * 11/1991 Staiger ..... F21S 48/1358 362/297

(Continued)

FOREIGN PATENT DOCUMENTS

EP 1058221 A2 12/2000
EP 0890059 B1 6/2004

(Continued)

*Primary Examiner* — Anh T Mai
*Assistant Examiner* — Steven Y Horikoshi
(74) *Attorney, Agent, or Firm* — Myers Bigel, P.A.

(57) ABSTRACT

An LED bulb with a down-reflecting optic is disclosed. Embodiments of the present invention can provide for an omnidirectional intensity distribution in the vertical plane for a vertically oriented solid-state lamp. In example embodiments, an optically transmissive enclosure is installed on the driver base. A plurality of LEDs are mounted on a mounting surface of the driver base, and an optical arrangement is disposed at least partially in an optical path from the plurality of LEDs to a central area of the optically transmissive enclosure to down-reflect at least some light from the plurality of LEDs. The optical arrangement can include a TIR optic with a spline-driving surface to down-reflect the at least some light from the plurality of LEDs, or a substantially flat mirror. Either may include a central aperture, and the optical arrangement may include a diffuser or diffusive areas.

21 Claims, 16 Drawing Sheets

(51) Int. Cl.

| | |
|---|---|
| *F21V 13/02* | (2006.01) |
| *F21Y 105/00* | (2016.01) |
| *F21Y 115/10* | (2016.01) |

(56) References Cited

U.S. PATENT DOCUMENTS

| | | | |
|---|---|---|---|
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,249 | B2 | 10/2012 | Liang et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,449,154 | B2 | 5/2013 | Uemoto et al. |
| 8,502,468 | B2 | 8/2013 | Li et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 2002/0163810 | A1* | 11/2002 | West ..... H01L 33/58 362/307 |
| 2004/0201990 | A1 | 10/2004 | Meyer |
| 2006/0067640 | A1* | 3/2006 | Hsieh ..... F21V 7/0091 385/146 |
| 2009/0184618 | A1 | 7/2009 | Hakata et al. |
| 2011/0101841 | A1* | 5/2011 | Qin ..... F21V 3/00 313/46 |
| 2011/0140149 | A1* | 6/2011 | Liu ..... F21V 7/041 257/98 |
| 2011/0205744 | A1* | 8/2011 | Kim ..... F21V 5/04 362/296.01 |
| 2012/0040585 | A1 | 2/2012 | Huang |
| 2014/0036496 | A1* | 2/2014 | Cai ..... G02B 19/0028 362/235 |
| 2014/0293582 | A1* | 10/2014 | Lee ..... G02B 19/0028 362/97.1 |
| 2015/0036342 | A1* | 2/2015 | Yang ..... F21K 9/50 362/241 |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

* cited by examiner

LED BULB WITH BACK-REFLECTING OPTIC

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and/or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is often needed to cool the LEDs and/or power supply in order to maintain appropriate operating temperature.

SUMMARY

Embodiments of the present invention can provide for improved luminous intensity distribution in the vertical plane for a vertically oriented solid-state lamp with a power supply or driver in the base. In some locales, government, non-profit and/or educational entities have established standards for SSL products, and luminous intensity distribution is typically part of such standards. As an example, a targeted distribution of light intensity over an angle of 0° to 135° is one of 75% to 125% of the average, where 0° is the angle at the top of the bulb. LED bulbs typically include electronic circuitry and in some cases, a heatsink, which may obstruct the light in the direction of a base with the power supply. Embodiments of the present invention can provide for better angular emission of light from the base of such a solid-state lamp or bulb to form the required omnidirectional distribution.

A solid-state bulb according to example embodiments of the invention includes a power supply, sometimes referred to as a "driver" that resides in the base of the bulb. Hence, the base may be referred to as a "driver base." An optically transmissive enclosure can be installed on the driver base. A plurality of LEDs are disposed on a mounting surface of the driver base, an optic, for example, a total-internal-reflection (TIR) optic is disposed at least partially in an optical path from the plurality of LEDs to a central area of the optically transmissive enclosure to down-reflect at least some light from the plurality of LEDs.

In some embodiments, the optic includes a spline-driving surface to down-reflect some light from the plurality of LEDs. In some embodiments, a TIR optic includes a central aperture. The combination of a spline-driving surface and a central aperture can enable the solid-state bulb to produce an omnidirectional distribution of light. The central aperture can have a diameter from about 5 mm to about 11 mm. In some embodiments, the TIR optic includes a plurality of support legs resting on the driver base to support the optic and properly position its surfaces. In some embodiments, the optic includes a support ring resting on the driver base to support the optic. A diffusive area can be included in or on the support legs and/or the support ring and/or the side of the TIR optic, as the case may be. This diffusive area can be or include, as examples, a diffusive coating, or a separate diffuser either outside or internal to the optical structure. Diffusion may also or instead be included in or on other portions of the optic as well.

In some embodiments, the TIR optic includes a flat bottom surface. The plurality of LEDs can be distributed beneath the flat bottom surface, circumscribable by a circle from about 15 mm to about 21 mm in diameter. The LEDs may emit different colors and may be in one or more device packages with or without phosphors. In some embodiments, when the lamp operates to produce an omnidirectional distribution of light, the plurality of LEDs are energized by the power supply and the down-reflecting surface reflects a first portion of the light from the plurality of LEDs, wherein some of a second portion of the light from the plurality of LEDs is emitted into a central area of a light transmissive enclosure, for example, through a central aperture of the optic. If the optic has a flat bottom surface, the first portion of the light from the plurality of LEDs enters the optic through the flat bottom surface.

In some embodiments, the LED bulb can include a substantially flat mirror as all or part of an optical arrangement that includes a down-reflecting surface. The mirror may include one or more apertures, and may include a central aperture. Such an optical arrangement can again enable the bulb to produce a more omnidirectional distribution of light. The central aperture may have a diameter from about 7 mm to about 11 mm. The optical arrangement with the mirror may include a diffusive area, which, in the case of a diffuser, may or may not cover any apertures. The diffusive area in the case of any optical arrangement may also include or consist of texturing on the surfaces of an optic, such as the TIR optic or the mirror.

BRIEF DESCRIPTION OF THE DRAWINGS

FIG. 3A is a perspective view, FIG. 3B is a top view, FIG. 3C is a cross-sectional view, and FIG. 3D is a bottom view.

FIG. 4A is a perspective view, FIG. 4B is a top view, FIG. 4C is a cross-sectional view, and FIG. 4D is a bottom view.

FIG. 7A is a top view of the optic, and FIG. 7B is a cross-sectional view.

FIG. 8A is a top view of the optic, and FIG. 8B is a cross-sectional view.

FIG. 9A is a top view of the optic, and FIG. 9B is a cross-sectional view.

FIG. 10A is a top view of the optic, and FIG. 10B is a cross-sectional view.

FIG. 11A is a top view of the optic, and FIG. 11B is a cross-sectional view.

FIG. 12A is a top view of the optic, and FIG. 12B is a cross-sectional view.

FIG. 13A is a top view of the optic, and FIG. 13B is a cross-sectional view.

FIG. 15A is a top view and FIG. 15B is a side view of the mirror.

DETAILED DESCRIPTION

Figure 1:
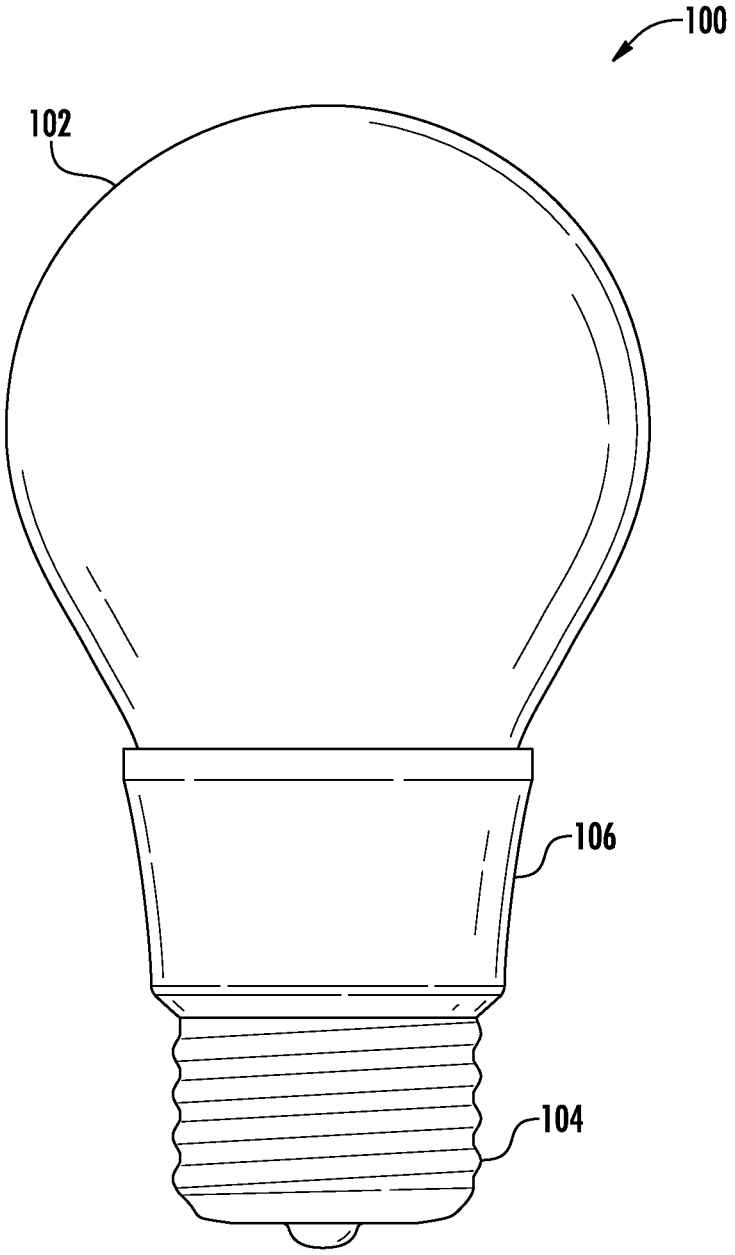
FIG. 1 is a side view of a solid-state lamp or LED bulb according to embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid-state light emitter" or "solid-state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid-state light emitters and/or multiple lumiphoric materials (i.e., in combination with at least one solid-state light emitter) may be used in a single device, such as to produce light perceived as white or near-white in character. In certain embodiments, the aggregated output of multiple solid-state light emitters and/or lumiphoric materials may generate warm white light output having a color temperature range of from about 2700K to about 4000K.

Solid-state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid-state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials may be associated with a lumiphor, a lumiphor binding medium, or a lumiphor support element that may be spatially segregated from a solid-state emitter.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

Figure 2B:
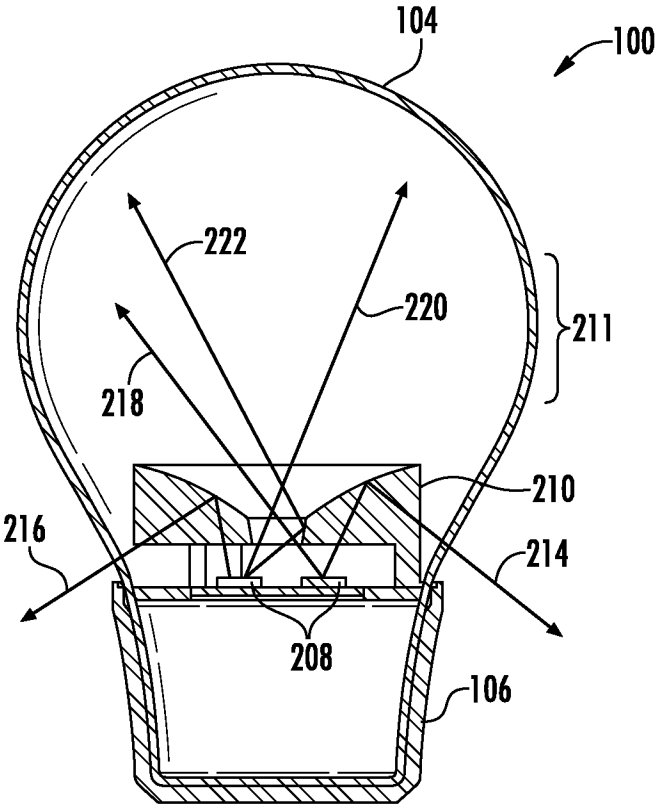
FIG. 2A is another side view of the solid-state lamp of FIG. 1 and a cross-sectional view, FIG. 2B of the same lamp, with the cross-section being indicated in the side view. The Edison screw connector shown in FIG. 1 is omitted for clarity.
FIG. 2, however this lamp includes an optical arrangement with a substantially flat ring mirror.
Figure 2A:
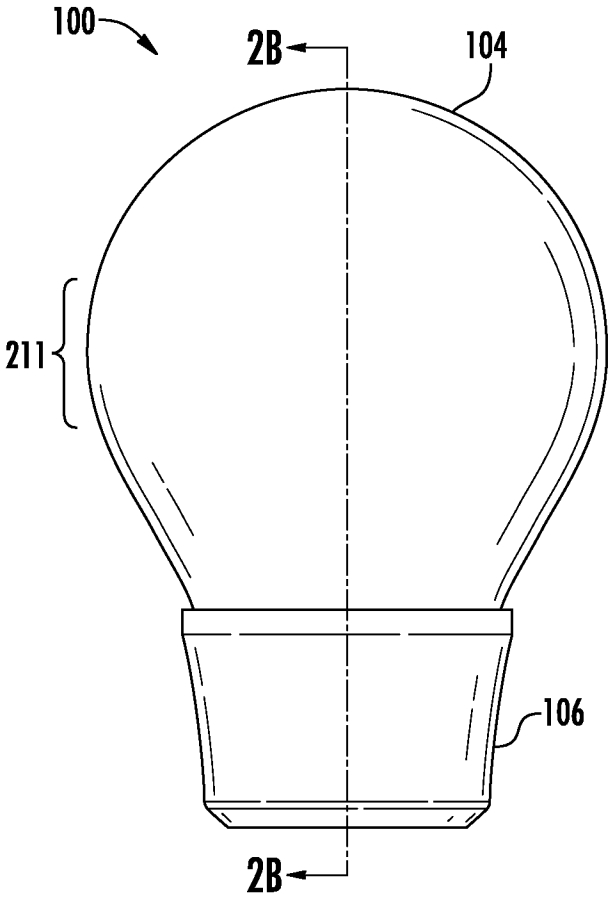

Example embodiments of the present invention provide for improved luminous intensity distribution in the vertical plane for a vertically oriented solid-state lamp with a power supply or driver in the base. The intensity distribution results in an omnidirectional distribution. The phrase, "vertically oriented" is used for reference only. The lamp according to example embodiments of the invention can be oriented in any direction and the advantages discussed herein will be equally realized. An embodiment of the invention can find use in a lamp of any form factor or shape; however, embodiments of the invention can be especially useful in SSL bulbs dimensioned to replace A-series incandescent bulbs. FIG. 1 illustrates an LED lamp/bulb 100. Bulb 100 includes an optically transmissive enclosure 102 covering the LEDs, an an Edison-style screw connector 104, and a driver base 106. FIGS. 2A and 2B show further views of bulb 100.

FIG. 2A shows the bulb with the screw base removed for clarity. Solid-state replacement bulbs can come with various connectors for use in different types of electrical systems and in different countries. Thus, the connector base is unimportant to the inventive concepts described herein. FIG. 2A indicates a cross-sectional view, which is in turn shown in FIG. 2B. In cross section, one can observe LED device packages 208 on a mounting surface of driver base 106. The mounting surface can be the top of a heatsink, on a circuit board on top of the heatsink, or on another intervening structure. The LEDs are connected through wiring (not shown) to a power supply (not shown) in the driver base. A power supply is sometimes referred to as a "driver" and resides in the base of the bulb. Hence, the base may be referred to as a "driver base." In this example embodiment, each LED devices package includes multiple LEDs.

A total-internal-reflection (TIR) optic 210 is inside the lamp, at least partially in an optical path from the plurality of LEDs to the central area 211 of the optically transmissive enclosure 102 to down-reflect at least some light from the plurality of LEDs. In the particular example of FIG. 2B, lights rays 214 and 216 show light being down-reflected by the top surface of the TIR optic. Light rays 218 and 220 are emitted through a central aperture of TIR optic 210 into the central area of the light transmissive enclosure, and light ray 222 reflects off the inside surface of the central aperture and is directed towards the side, but still through optically transmissive enclosure 102.

Figure 3A:
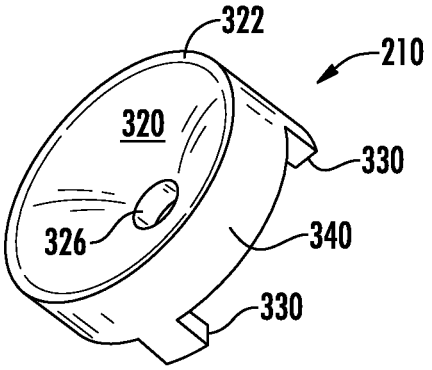
FIGS. 3A, 3B, 3C, and 3D are four views of one example TIR optic that finds use with embodiments of the present invention.
Figure 3B:
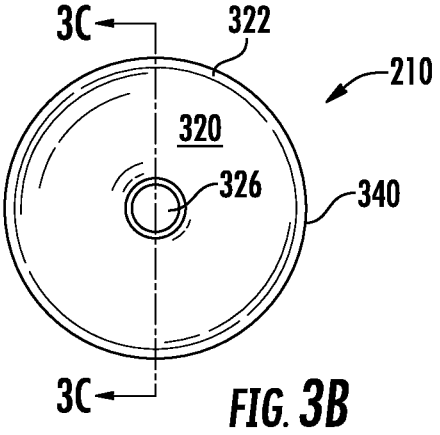
Figure 3C:
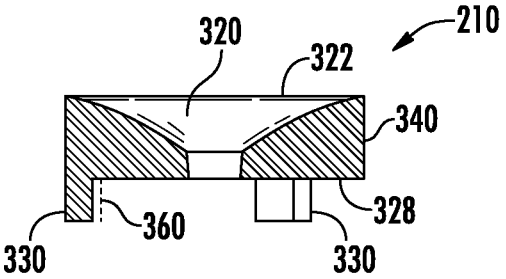
Figure 3D:
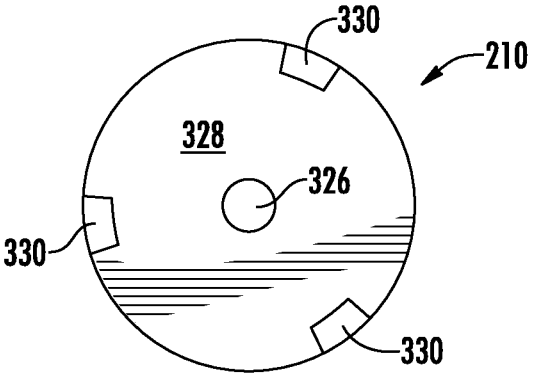

FIGS. 3A, 3B, 3C, and 3D show various views of TIR optic 210 of FIGS. 2A and 2B. FIG. 3A is a perspective view. FIG. 3B is a top view, with a cross-sectional indicator for FIG. 3C, which is a cross-sectional view. FIG. 3D is a bottom view. TIR optic 210 includes a down-reflecting surface 320. In this example, this down-reflecting surface is follows a spline curve and such a surface may be referred to herein as a "spline-driving" surface because drives the light generally downwards. Thus, in the vertical plane, this surface is piecewise-defined by polynomial functions. At the edge of surface 320 is a small flat rim 322. TIR optic 210 also includes a central aperture 326 and a flat bottom surface 328, through which a portion of light from the plurality of LEDs enters the optic. Optic 210 also includes a plurality of support legs 330. The side 340 of the optic is essentially cylindrical. A diffusive area 360 is visible in FIG. 3C. The diffusive area can be provided in or on at least one of the plurality of support legs. This area can be a coating on the leg, a material or structure molded inside the leg, or a physically separate diffuser. Diffusing some of the light from the LEDs in this area can further reduce shadows and aid in making the light uniform.

The optic of FIGS. 3A, 3B, 3C, and 3D has an outside diameter of about 33.5 mm. The central aperture has a diameter at the bottom of about 9 mm and has about a 10 degree taper. The support legs are about 5 mm high and the optic has a total height of about 14 mm.

Observing FIGS. 2A and 2B, and FIGS. 3A, 3B, 3C, and 3D together, one can appreciate that when bulb 100 with TIR optic 210 operates, that is when LEDs in device packages 208 are energized; a first portion of the light from the LEDs enters the optic through the bottom surface and is down-reflected by the spline-driving surface. A second portion of the light from the plurality of LEDs passes into the central area of the light transmissive enclosure 102 through the central aperture of the TIR optic. In at least some embodiments, some of this second portion of light can pass directly from the LED device packages through the central aperture, and some of this second portion of the light reflects off the sides of the aperture and then passes into the optically transmissive enclosure. By "central area" of the light transmissive enclosure, what is meant is a substantial portion of the interior of the enclosure that is centered vertically. For purposes of this description, the edges of the enclosure where some of the light rays that reflect of the sides of the aperture are directed are considered part of the central area. Light rays from these portions help in uniformly constructing the omnidirectional distribution.

Figure 4A:
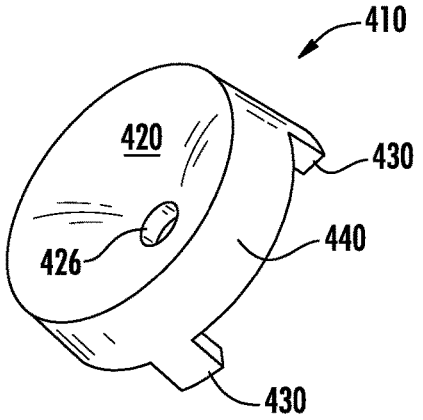
FIGS. 4A, 4B, 4C, and 4D are four views of another example TIR optic that finds use with embodiments of the present invention.
Figure 4B:
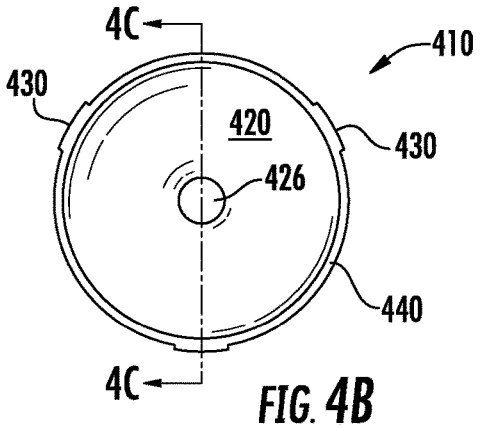
Figure 4C:
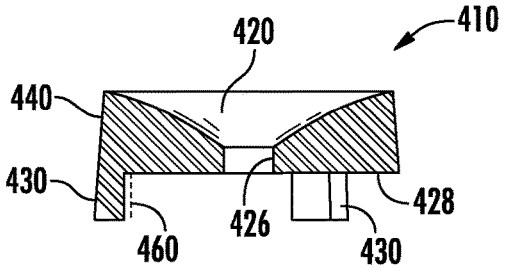
Figure 4D:
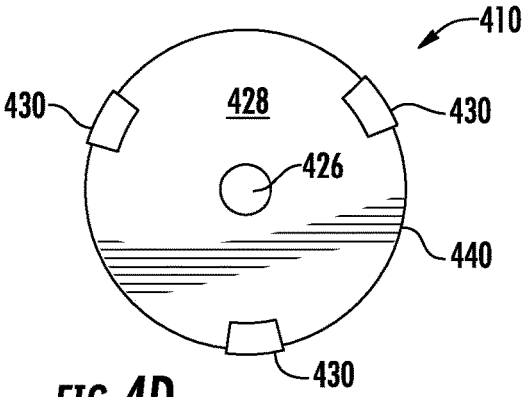

FIGS. 4A, 4B, 4C, and 4D show an alternative embodiment of an optic that can be used in a lamp like lamp 100. FIGS. 4A, 4B, 4C, and 4D show an optic, 410, without the flat ring on the outer edge of the spline-driving top surface and with a smaller central aperture. FIG. 4A is a perspective view. FIG. 4B is a top view, with a cross-sectional indicator for FIG. 4C, which is a cross-sectional view. FIG. 4D is a bottom view. TIR optic 410 includes a down-reflecting surface 420. The down-reflecting surface again follows a spline curve. TIR optic 410 also includes a central aperture 426 and a flat bottom surface 428, through which a portion of light from the plurality of LEDs enters the optic. Optic 410 also includes a plurality of support legs 430. Sides 440 of optic 410 are angled slightly. A diffusive area 460 is visible in FIG. 4C. The diffusive area can be provided in or on at least one of the plurality of support legs. This area can be a coating on the leg, a material or structure molded inside the leg, or a physically separate diffuser.

The optic of FIGS. 4A, 4B, 4C, and 4D has an outside diameter at the bottom of the prism portion of about 33.5 mm and about a 5 degree taper. The central aperture has a diameter of about 5 mm. The support legs are about 5 mm high and the optic has a total height of about 14 mm. Thus, for TIR optics with support legs according to some example embodiments, a central aperture can vary in size from about 5 mm to about 9 mm in diameter.

Figure 5:
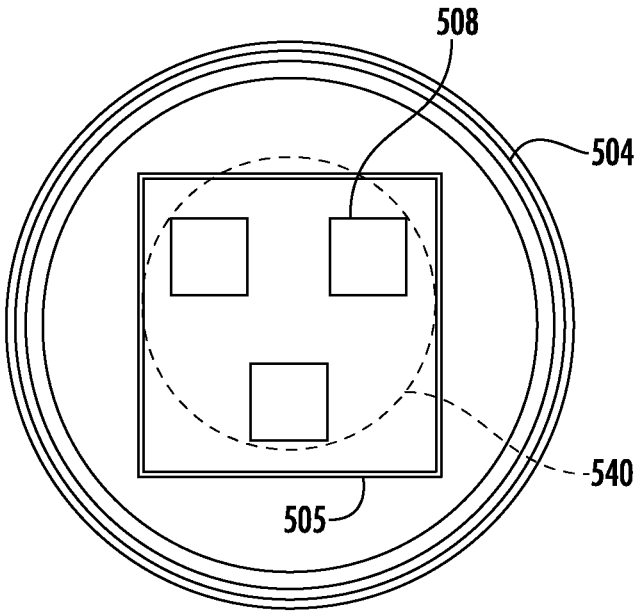
FIG. 5 and FIG. 6 show two alternative placements of LED device packages on a mounting surface of a driver base for a lamp according to example embodiments of the present invention.
Figure 6:
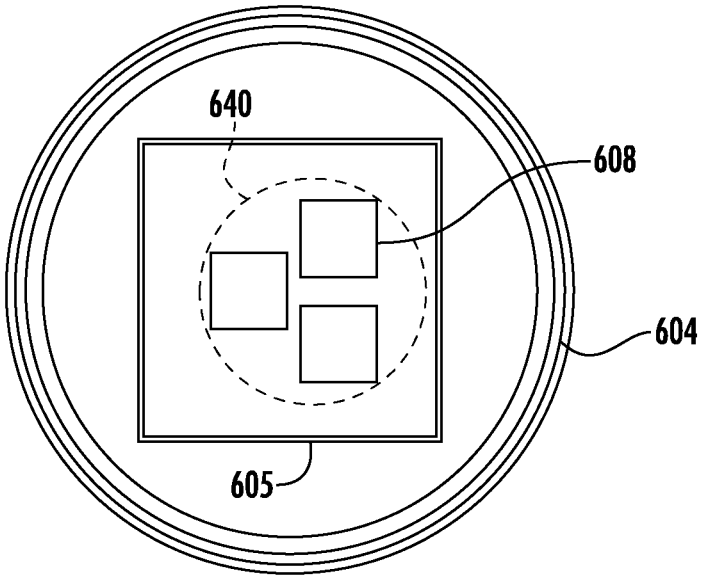

FIGS. 5 and 6 show bulbs with the optically transmissive enclosure and down-reflecting optic removed, revealing LEDs in device packages on the mounting surface of the driver base. FIG. 5 shows driver base 504 with a circuit board mounting surface 505. Three LED device packages 508 are mounted on mounting surface 505 of driver base 504. Thus, the LEDs are circumscribable by an "imaginary" circle 540 of about 21 mm in diameter. FIG. 6 shows driver base 604 with a circuit board mounting surface 605. Three LED device packages 608 are mounted on mounting surface 605 of driver base 604. In this case, the LEDs are circumscribable by an "imaginary" circle 640 of about 15 mm in diameter. FIG. 5 and FIG. 6 illustrate that the LEDs in use in a lamp or bulb according to example embodiments of the invention can be spaced and/or distributed either close together or with more space in between. Having them spaced apart further is better for heat dissipation; however, better optical performance can be achieved with the LEDs closer together. In any case, the appropriate polynomials and break points for the spline driving surface can be determined using a ray trace tool based on the LED placement selected. The size of the central aperture can also be adjusted appropriately. A smaller aperture would typically be used for LEDs with a smaller footprint. It should be noted that an optic without a central aperture can also be designed. Such an optic would need a central surface that allowed a portion of the light rays to pass through the optic without being reflected downward. However, it has been found that use of a central aperture reduces shadows, especially if the LEDs are distributed substantially outside of the footprint of the aperture between the flat bottom surface of the optic and the mounting surface.

A TIR optic (lens) according to example embodiments of the invention can provide a relatively omnidirectional light distribution in an A-series replacement bulb, such as an A19 lamp. Light intensity provided can be from 75% to 125% of the average value over a vertical angle from 0° to 135°. The TIR lens can be installed to rest on or near the LED mounting surface, which may be a printed circuit board on the driver base, or on a reference plate inside the light bulb glass and allows the light rays from the lamp to be distributed in some embodiments with an optical efficiency of at least 95%.

In some example embodiments, the TIR optic includes a cylindrical or tapered prism shape that is most observable on the sides, and a spline-driving top surface. The spline-driving top surface of the optic can enables the light rays to be down-directed in order to build the omnidirectional distribution pattern. Use of a spline-driving top surface can also enable the light rays to become uniform by continuously or at least almost continuously varying the surface curvature for reflected rays, thus also varying their direction. A central aperture can enhance the uniformity of the distribution. Shadows and/or hot spots with some fringes can still form in the lower portion of the optical enclosure due to overlap or clustered rays by complicated ray directions in the lower bulb. Adding a diffusive area or diffuser, even for example, scotch tape, or a textured surface on the side of a support leg and/or on the side of the TIR lens itself can reduce the shadows.

Wide LED placement on the bottom of the optical chamber is designed to improve thermal performance, but this wide placement has an adverse effect on the omnidirectional distribution. Decreased adjacent LED placement distance enables the TIR lens to have better optical performance. One of skill in the art can design a lamp with an appropriate balance for a given application. The TIR lens can be made of clear, low-cost material such as acrylic or silicone.

Figure 7A:
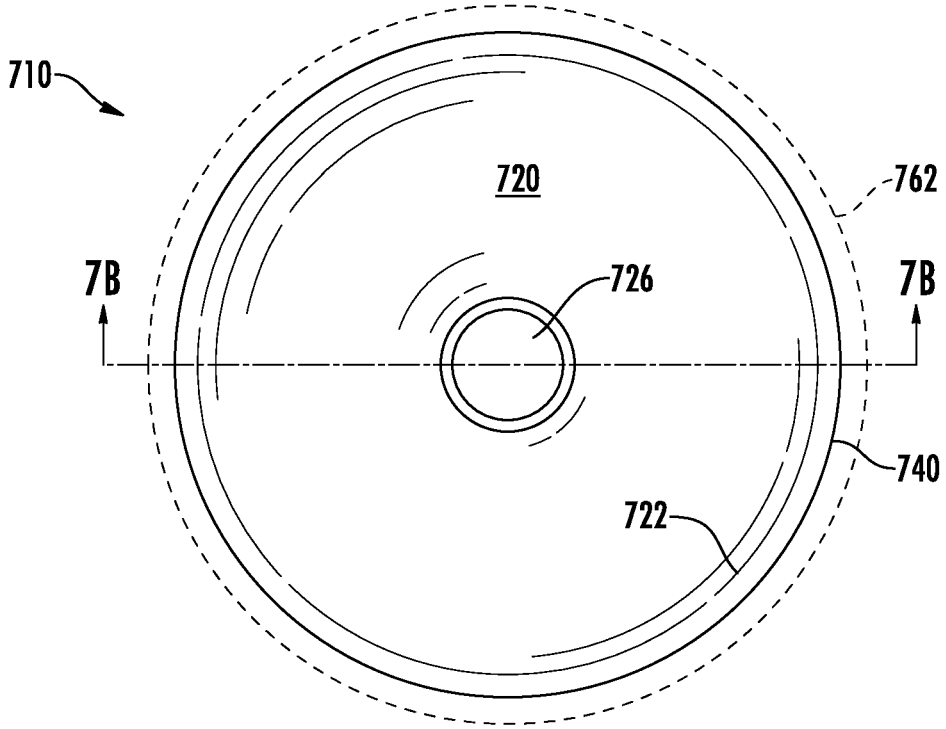
FIGS. 7A and 7B are two views of another example TIR optic that can find use with embodiments of the invention.
Figure 7B:
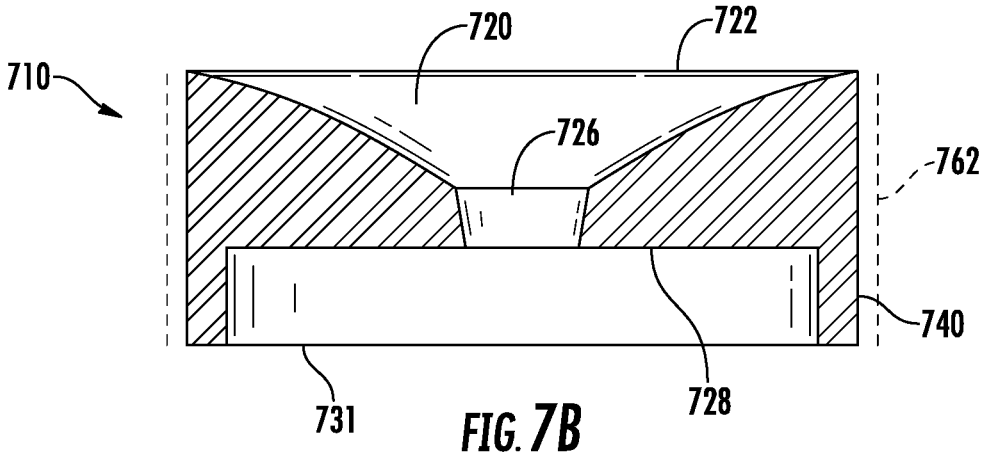

FIGS. 7A-14B illustrate top views and cross-sectional views of various alternate embodiments of the TIR optic. All of these lenses feature a support ring instead of support legs for supporting the optic on the driver base or other surface in the bulb. The other variations in optical features from optic to optic can also be used with optics that use support legs. FIGS. 7A and 7B illustrate an optic that is similar to that discussed with respect to FIGS. 3A, 3B, 3C, and 3D, except that it has a support ring and a diffusive area on the side. FIG. 7A is a top view and FIG. 7B is a cross-sectional view. TIR optic 710 includes a spline-driving down-reflecting surface 720. At the edge of surface 720 is a small flat rim 722. TIR optic 710 also includes a central aperture 726 and a flat bottom surface 728, through which a portion of light from the plurality of LEDs enters the optic. Optic 710 includes a support ring 731. The side 740 of the optic is essentially cylindrical. An optional diffusive area 762 is included in or on the cylindrical side of the optic. This diffusive area can be a coating, a material or structure molded inside the optic, or a physically separate diffuser.

Figure 8A:
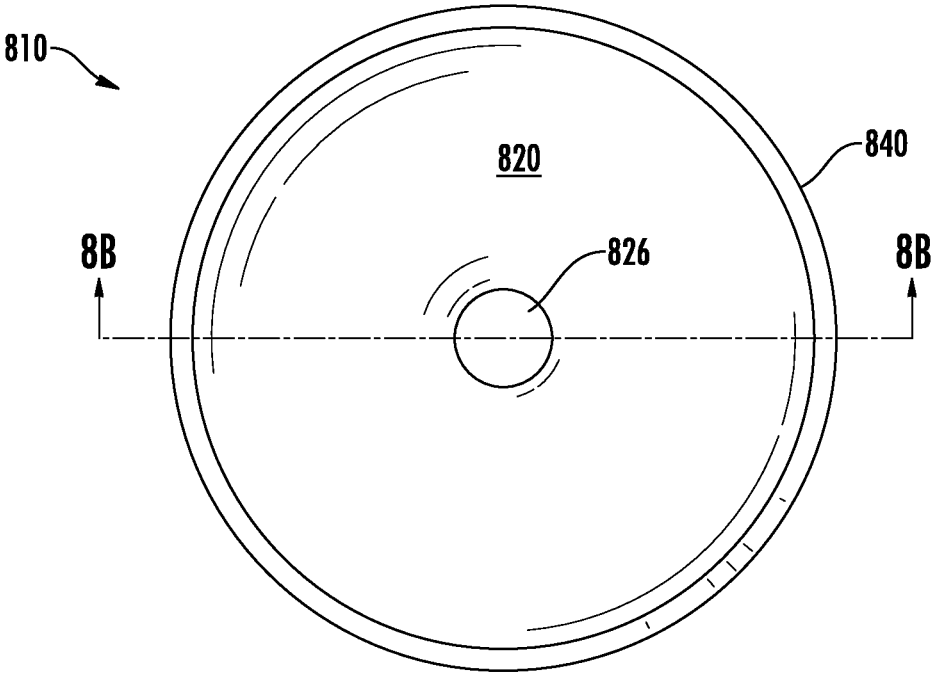
FIGS. 8A and 8B are two views of another example TIR optic that can find use with embodiments of the invention.
Figure 8B:
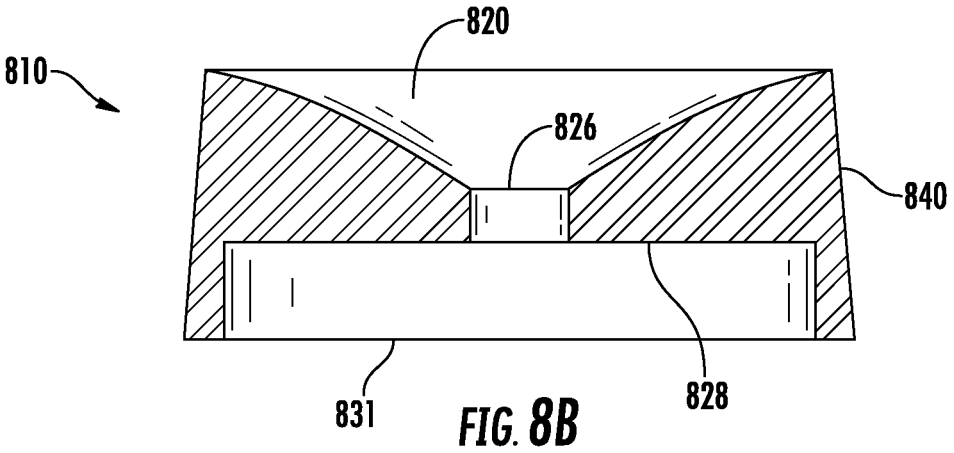

FIGS. 8A and 8B illustrate an optic that is similar to that discussed with respect to FIGS. 4A, 4B, 4C, and 4D, except that it has a support ring instead of support legs. FIG. 8A is a top view and FIG. 8B is a cross-sectional view. TIR optic 810 includes a spline-driving down-reflecting surface 820. TIR optic 810 also includes a central aperture 826 and a flat bottom surface 828, through which a portion of light from the plurality of LEDs enters the optic. Optic 810 includes a support ring 831. The side 840 of the optic is angled.

Figure 9A:
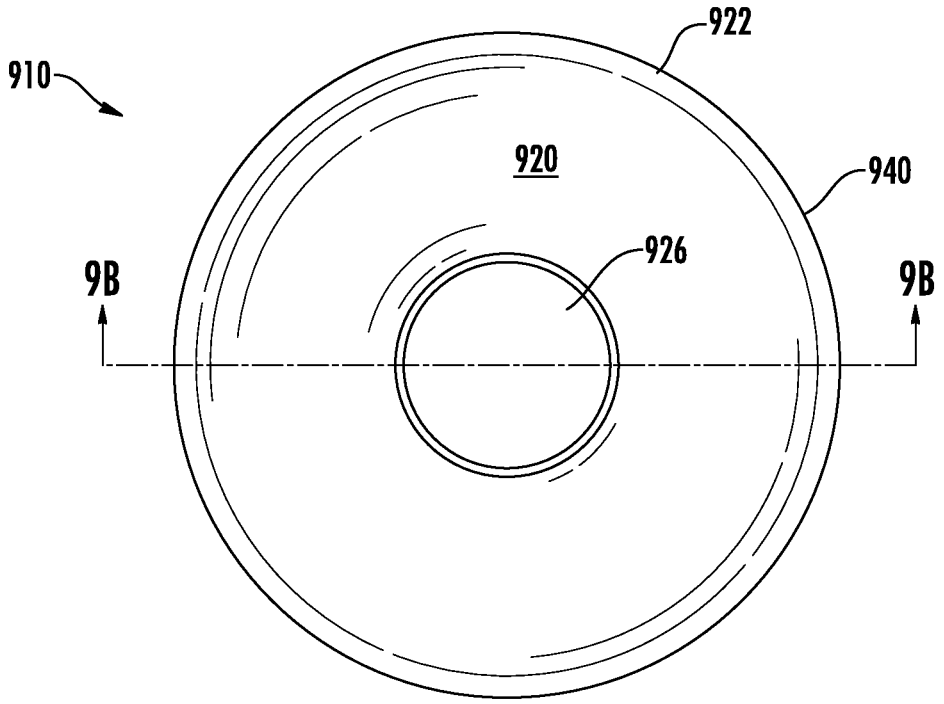
FIGS. 9A and 9B are two views of another example TIR optic that can find use with embodiments of the invention.
Figure 9B:
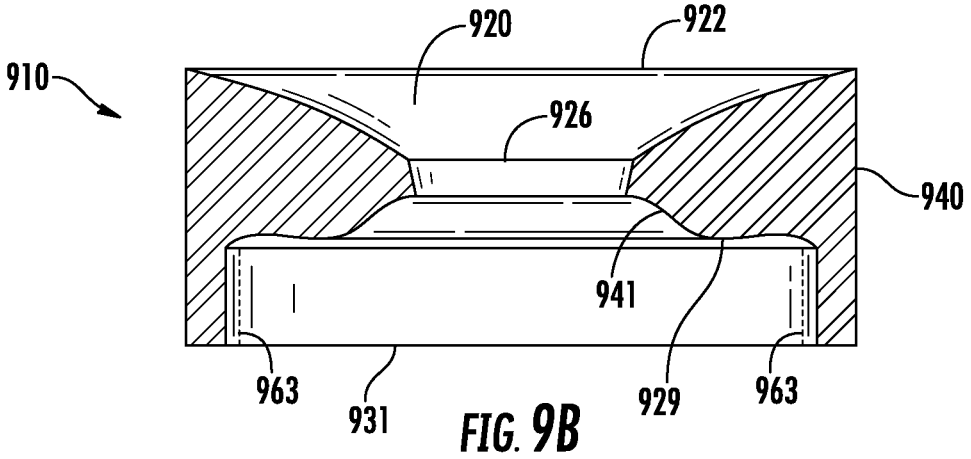

FIGS. 9A and 9B illustrate another TIR optic with a support ring instead of support legs. FIG. 9A is a top view and FIG. 9B is a cross-sectional view. TIR optic 910 includes a spline-driving down-reflecting surface 920. TIR optic 910 also includes rim, 922, a central aperture 926 and a bottom surface 929, through which a portion of light from the plurality of LEDs enters the optic. Optic 910 includes a support ring 931 and a cylindrical side 940. It should be noted that the aperture 926 is more complex, being larger and with a widened area at the bottom. The wider area creates surface 941, which can reflect some light rays at a different angle than the more vertical inner portion of the central apertures shown herein thus far. Also, bottom surface 929 is not flat, but curves up near the sides of the optic. Such an arrangement of surfaces has been found to further improve shadows and hot spots with some LED spacings. An optional diffusive area 963 is included in or on the support ring 931. This diffusive area can be a coating, a material, a structure molded inside the optic, or a physically separate diffuser.

Figure 10A:
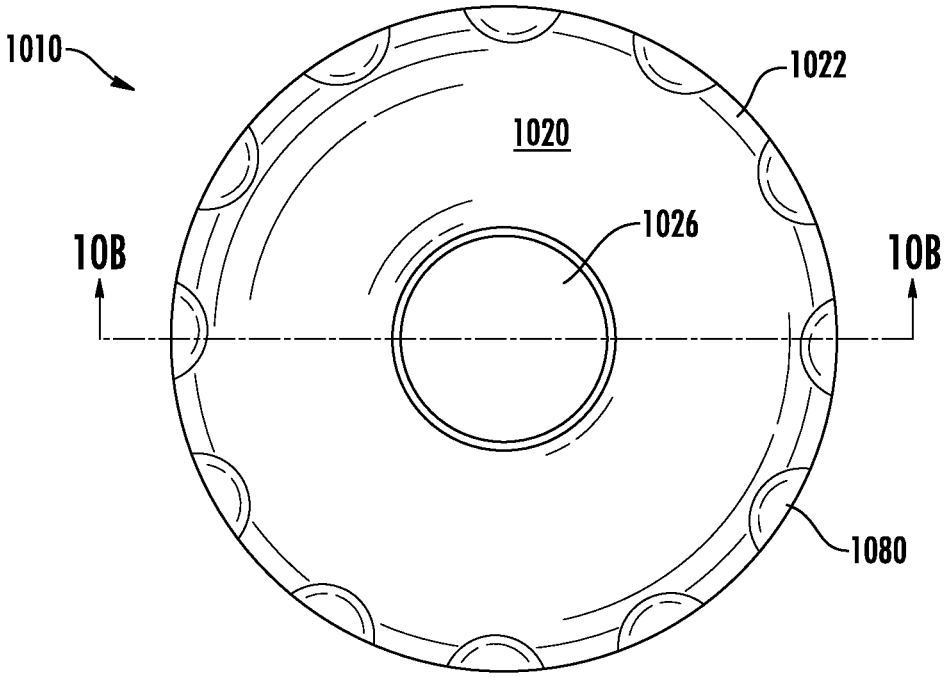
FIGS. 10A and 10B are two views of another example TIR optic that can find use with embodiments of the invention.
Figure 10B:
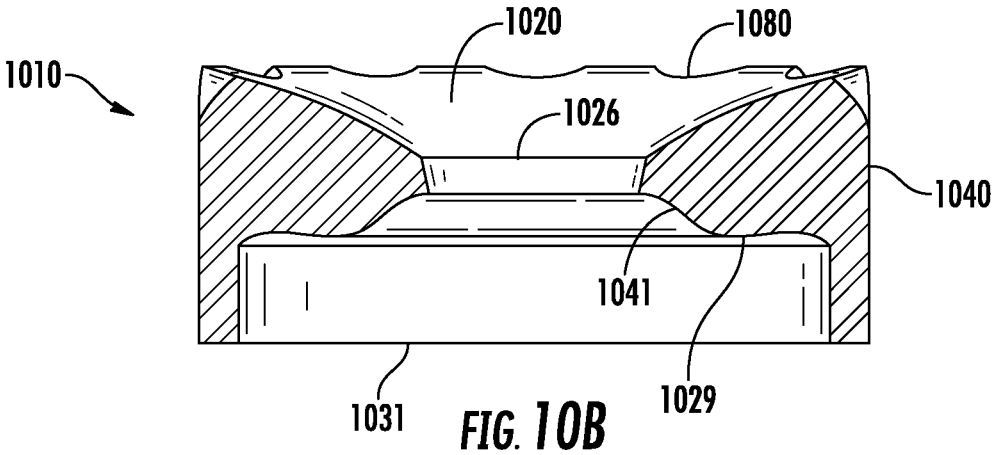

FIGS. 10A and 10B illustrate another TIR optic with a support ring instead of support legs. FIG. 10A is a top view and FIG. 10B is a cross-sectional view. TIR optic 1010 includes a spline-driving down-reflecting surface 1020. TIR optic 1010 also includes rim, 1022, a central aperture 1026 and a bottom surface 1029, through which a portion of light from the plurality of LEDs enters the optic. Optic 1010 includes a support ring 1031, and a cylindrical side 1040. The aperture of the optic in FIGS. 10A and 10B, like that shown in FIGS. 9A and 9B, has a more complex configuration with a wider area that creates surface 1041, which can reflect some light rays at a different angle than the more vertical inner portion of the other central apertures shown herein thus far. Again, bottom surface 1029 is not flat, but curves up near the sides of the optic. The curved bottom surface 1029 helps light rays from the LEDs in extending further along the edges of top surface 1020 by refraction. The edges of the top surface direct the light rays downwards, eventually contributing to an improved omnidirectional distribution.

Still referring to FIGS. 10A and 10B, optic 1010 includes small cuts 1080 in the top edge, rimmed surface. It has been found that such patterning around the edge of the top of the optic reduces the appearance of hot spots and shadows, while not severely impacting the omnidirectional characteristics of a lamp or bulb using the optic. These cuts can take any of various shapes, and can take the form of divots or indentations.

Figure 11A:
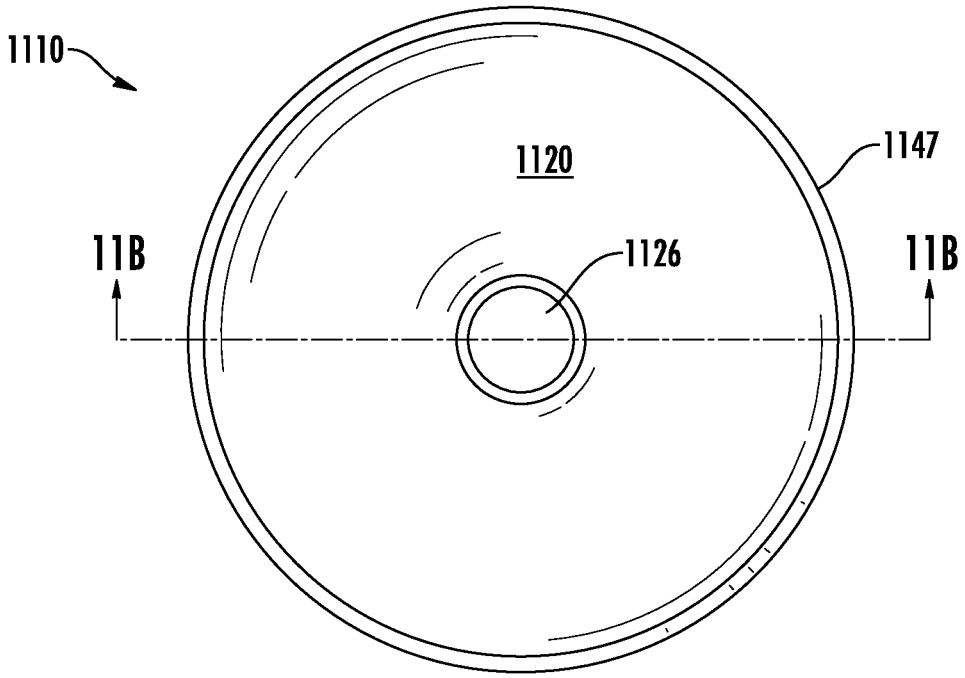
FIGS. 11A and 11B are two views of another example TIR optic that can find use with embodiments of the invention.
Figure 11B:
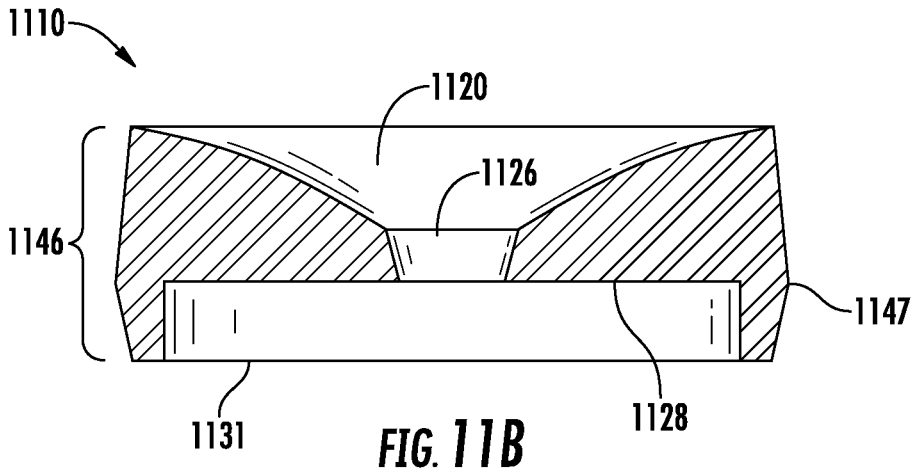

FIGS. 11A and 11B another example TIR optic according to example embodiments of the invention. FIG. 11A is a top view and FIG. 11B is a cross-sectional view. Larger TIR optic 1110 includes a spline-driving down-reflecting surface 1120. TIR optic 1110 also includes a central aperture 1126 and a flat bottom surface 1128, through which a portion of light from the plurality of LEDs enters the optic. Optic 1110 includes a support ring 1131. The side 1146 of the optic is shaped slightly differently than the other optics presented herein thus far. Side 1146 of optic 1110 has a bend 1147 at the same point vertically as the flat bottom surface 1128. Dimensions for this and the other TIR lenses using a support ring are discussed below.

Figure 12A:
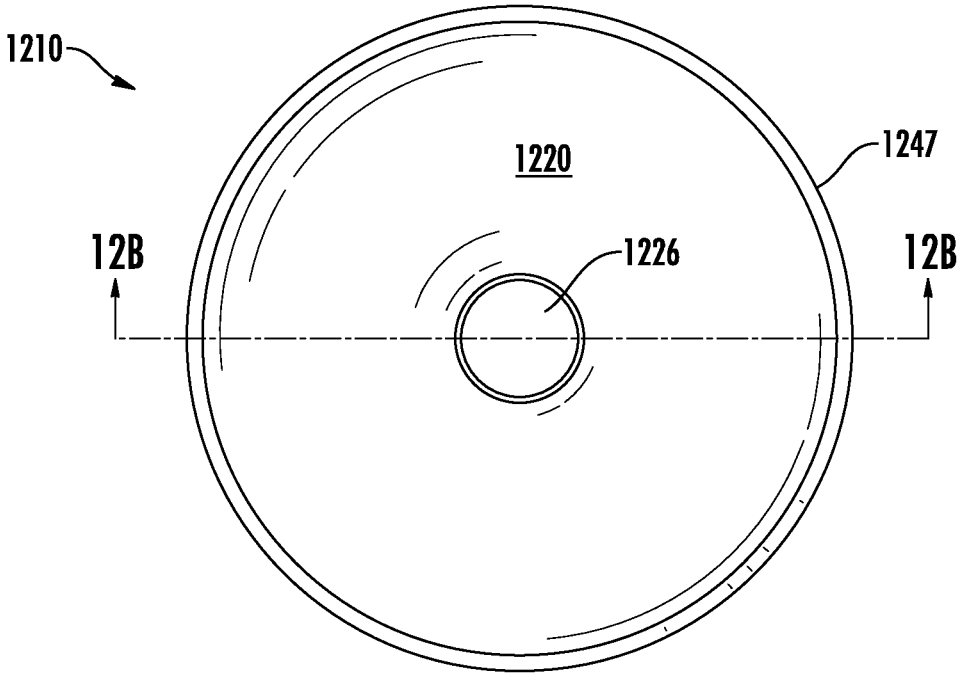
FIGS. 12A and 12B are two views of another example TIR optic that can find use with embodiments of the invention.
Figure 12B:
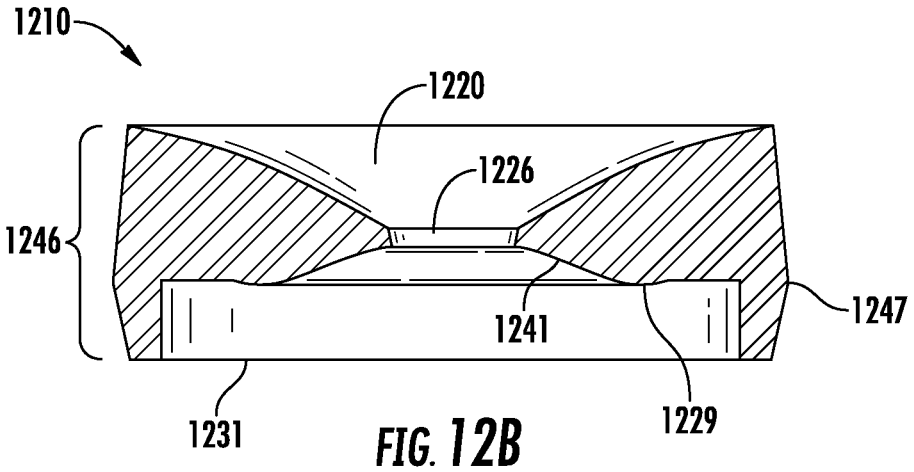

FIGS. 12A and 12B another example TIR optic according to example embodiments of the invention. FIG. 12A is a top view and FIG. 12B is a cross-sectional view. TIR optic 1210 includes some features of an optic like that shown in FIG. 11 and some like the optics shown in FIGS. 9A and 9B, and 10A and 10B. Optic 1210 includes a spline-driving down-reflecting surface 1220. TIR optic 1210 also includes a central aperture 1226 and a curved bottom surface 1229, through which a portion of light from the plurality of LEDs enters the optic. Optic 1210 includes a support ring 1231. Side 1246 of optic 1210 has a bend 1247 at roughly the same point vertically as the bottom surface 1229.

Figure 13A:
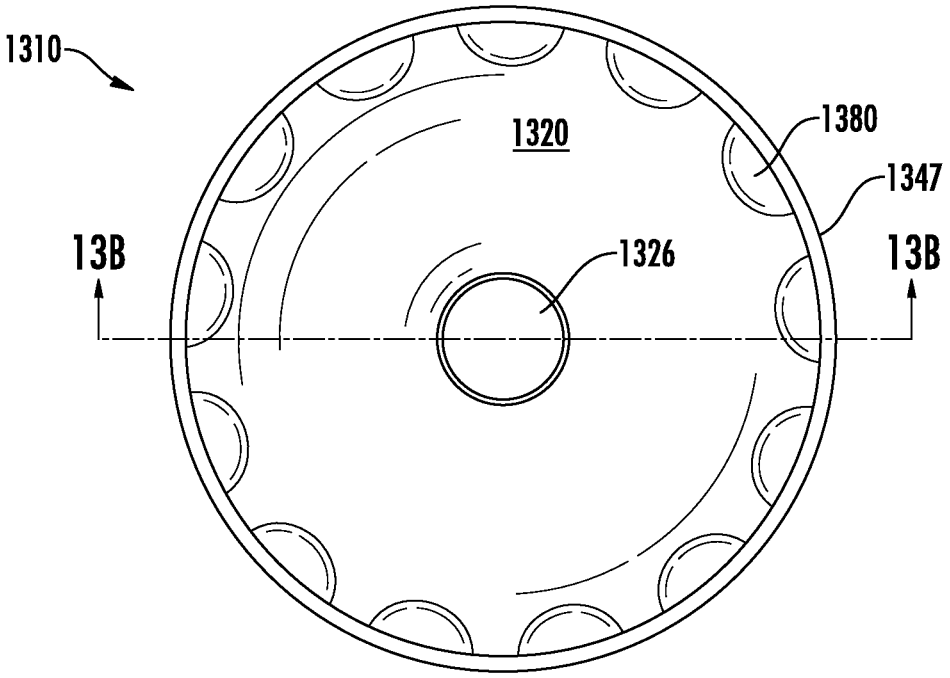
FIGS. 13A and 13B are two views of another example TIR optic that can find use with embodiments of the invention.
Figure 13B:
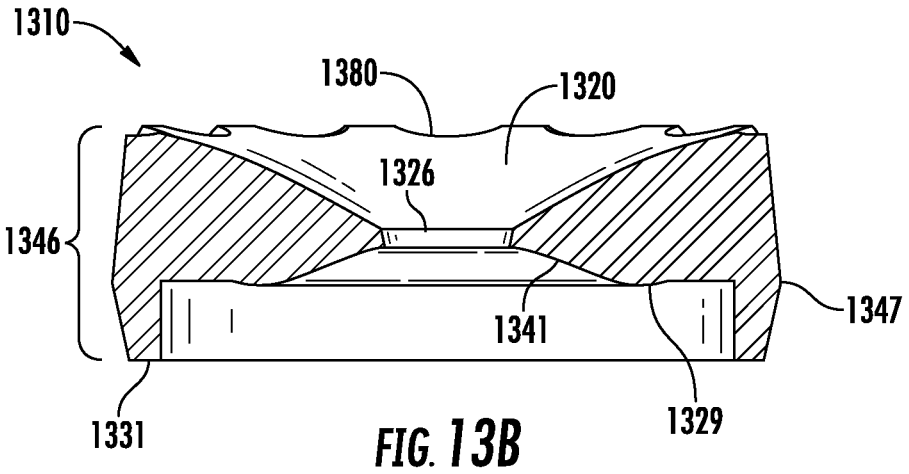

FIGS. 13A and 13B another example TIR optic according to example embodiments of the invention. FIG. 13A is a top view and FIG. 13B is a cross-sectional view. TIR optic 1310 is similar in many ways to the optic of FIGS. 12A and 12B. Optic 1310 includes a spline-driving down-reflecting surface 1320. TIR optic 1310 also includes a central aperture 1326 and a curved bottom surface 1329, through which a portion of light from the plurality of LEDs enters the optic. Optic 1310 includes a support ring 1331. Side 1346 of optic 1310 has a bend 1347 at roughly the same point vertically as the bottom surface 1329. Optic 1310 has the complex aperture with a wider area that creates surface 1341, which can reflect some light rays at a different angle than a more vertical inner portion of the central aperture. Finally, the optic of FIGS. 13A and 13B includes small cuts 1380 in the top edge. Again, such patterning around the edge of the top of the optic reduces the appearance of hot spots and shadows, while not severely impacting the omnidirectional characteristics of a lamp using the optic. These cuts can take any of various shapes, and can take the form of divots or indentations.

The optics of FIGS. 7A-10B all have an outside diameter at its widest point of about 33.5 mm, and an overall height of about 14 mm. The support ring is about 5 mm high in each one. The diameter of the central apertures varies from about 8 mm to about 11 mm. These TIR lenses have been found effective with LED device packages distributed under the bottom surface so as to be circumscribable by a circle of about 20.5 mm in diameter. Bulbs using them have efficiencies of at least about 90%, but in some cases, a bulb using such an optic can have an efficiency of at least about 98%.

The optics of FIGS. 11A-13B are larger and can find use in larger solid-state lamps or bulbs. These optics have a diameter at the narrowest points of about 40 mm, and a diameter at the widest point of about 42 mm. The overall height of these optics is about 14.5 mm. These TIR lenses can find use in larger bulbs and have been found to be effective with LED device packages distributed under the bottom surface so as to be circumscribable by a circle of about 19 mm in diameter. Efficiencies are at least 92% can be achieved, with some configurations having an efficiency of at least 97%. The diameter of the central apertures of these larger optics again varies from about 8 mm to about 11 mm. Thus, the diameter of the central apertures of TIR optics as shown in this disclosure can be from about 5 mm to about 11 mm.

Figure 14:
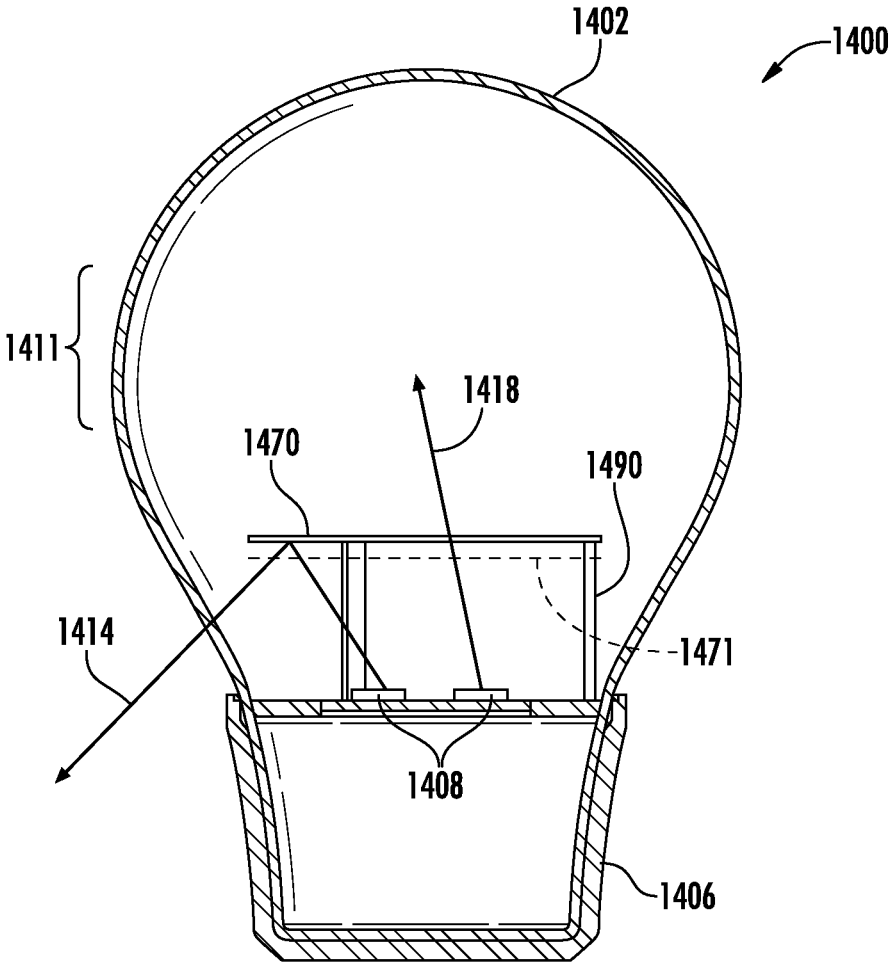
FIG. 14 is a cross-sectional view of a solid-state replacement bulb according to further embodiments of the invention. This bulb is similar to that shown in FIG. 1.

FIG. 14 illustrates an LED lamp/bulb 1400 according to other embodiments of the invention. Bulb 1400 includes an optically transmissive enclosure 1402 covering the LEDs, and a driver base 1406. The screw base or other connector for connecting the bulb to the mains is removed for clarity. FIG. 14 is a cross-sectional view, which is a similar view of a bulb to that shown in FIG. 2B. As before, LED device packages 1408 are installed on a mounting surface of driver base 1406. The mounting surface can be the top of a heatsink, a circuit board on top of the heatsink, or on some other intervening structure. The LEDs are connected through wiring (not shown) to a power supply (not shown) in the driver base. In this example embodiment, each package includes multiple LEDs. In this particular embodiment, an optical arrangement in an optical path from the plurality of LEDs to a central area 1411 of the optically transmissive enclosure 1402 again down-reflects at least some light from the plurality of LEDs. However, in this case, the optical arrangement is or includes a ring-shaped mirror, 1470. Optionally, a diffusive area 1471 can be included as part of the optical arrangement.

Still referring to FIG. 14, light ray 1414 shows light being down-reflected by the bottom surface of mirror 1470. Light ray 1418 is emitted through a central aperture of mirror 1470 into the central area of the light transmissive enclosure. If the diffusive area, which can be a coating, a separate diffuser or an adhesive material, is below the mirror and has no aperture, all light rays pass through the diffusive area. The mirror and/or a diffuser, if any, can be supported within the bulb by stanchion 1490. It should be noted that the term "mirror" is intended in its broadest sense. A mirror as shown herein can be any reflector and can be made of various materials. The reflector can have a surface on the bottom to down-reflect light that is either diffuse or specular.

Figure 15A:
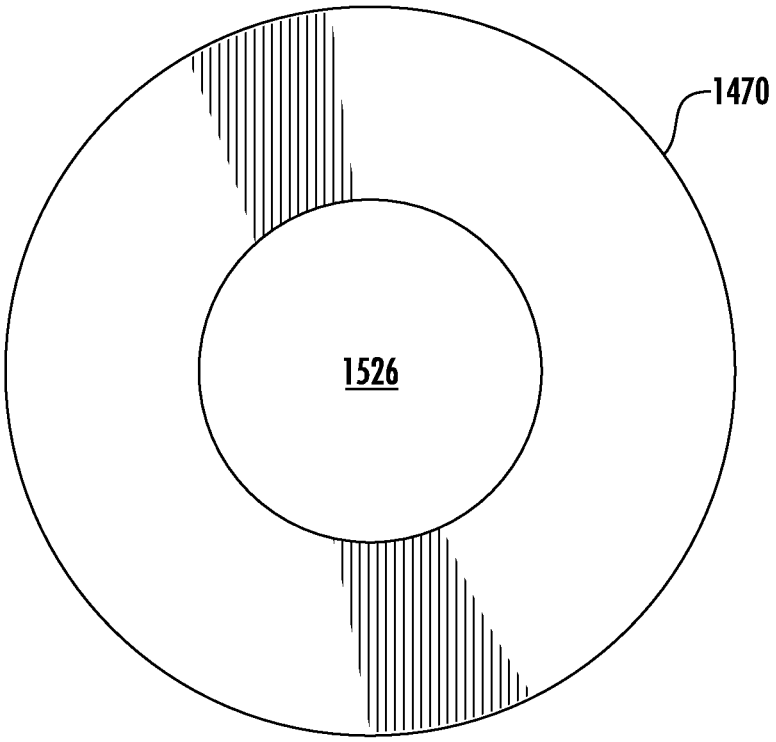
FIGS. 15A and 15B show a mirror that can find use with an embodiment of the invention, namely, the mirror that is shown in FIG. 14.
Figure 15B:
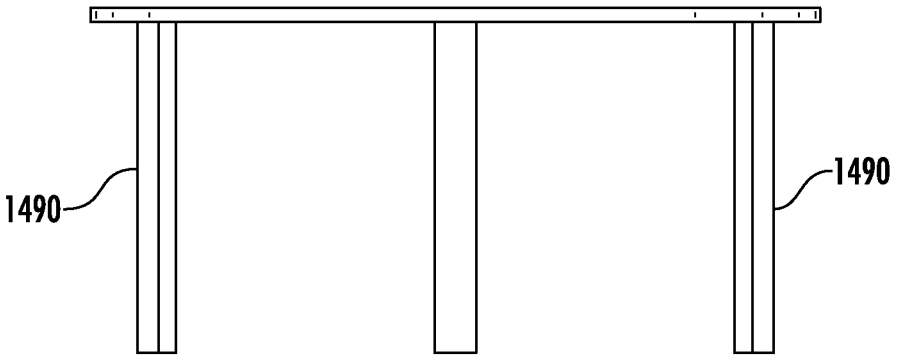
Figure 16:
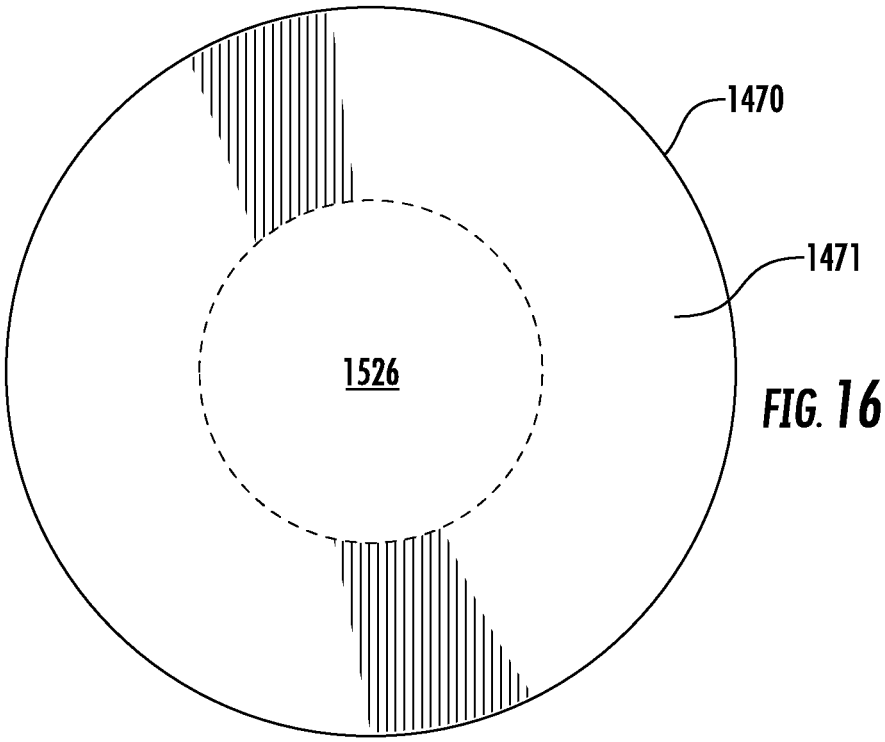
FIG. 16 is a bottom view of the optical arrangement from FIG. 14, showing the mirror with the diffuser underneath.

FIG. 15A is a top-down view of ring-shaped mirror 1470 with central aperture 1526 and FIG. 15B is a side view in which support stanchions 1490 are visible. The mirror can have an outside a diameter of from about 32 mm to about 34 mm. The diameter of the central aperture can be from about 7 mm to about 11 mm in diameter. In the bulb it can be supported on stanchions from about 14 mm to about 16 mm high. FIG. 16 is a bottom-up view of an optical arrangement for the lamp of FIG. 14. In this particular view, a physical diffuser 1471 is shown and can be seen covering aperture 1526 of mirror 1470.

Figure 17:
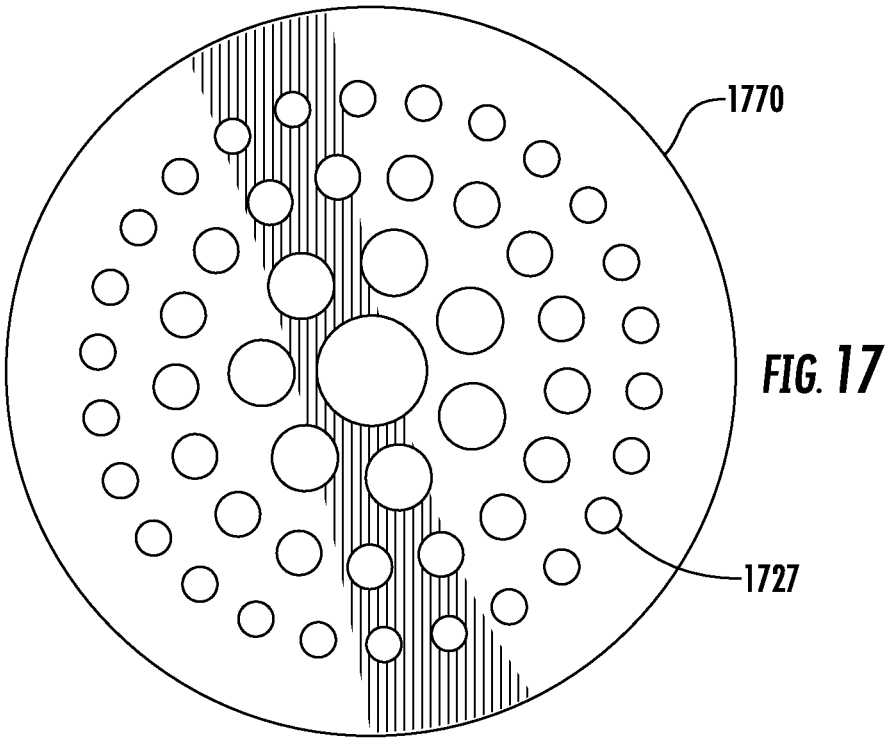
FIG. 17 shows a top view of another example mirror that can be used with some embodiments of the present invention.

FIG. 17 is a top-down view of a down-reflecting mirror according to additional embodiments of the invention. Mirror 1770 has multiple apertures of varying sizes, such as aperture 1727. These apertures vary in size from about 1 mm to about 5 mm in diameter. Such a pattern of apertures can reduce the appearance of hot spots and shadows within or from a bulb using the optical arrangement, while still maintaining some of the omnidirectional optical characteristics of the bulb. A similar effect can be achieved with an arrangement of slots or other types of openings in addition to the central aperture. For example, semicircular slots from about 1 to 2 mm wide can be cut at various distances from a central aperture.

Down-reflecting optics for an A-series solid-state replacement lamp or bulb according to embodiments of the invention as described herein have an outside diameter from about 32 mm to about 42 mm, and a central aperture with a diameter from about 5 mm to about 11 mm. Such an optic can be a TIR lens or a reflector. They can be used in an optical arrangement including a diffusive area. The various portions of a solid-state lamp according to example embodiments of the invention can be made of any of various materials. TIR lenses can be made, as examples, of acrylic or silicone. Heatsinks can be made of metal or plastic, as can the various portions of the housings for the components of a lamp. A lamp according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Figure 18:
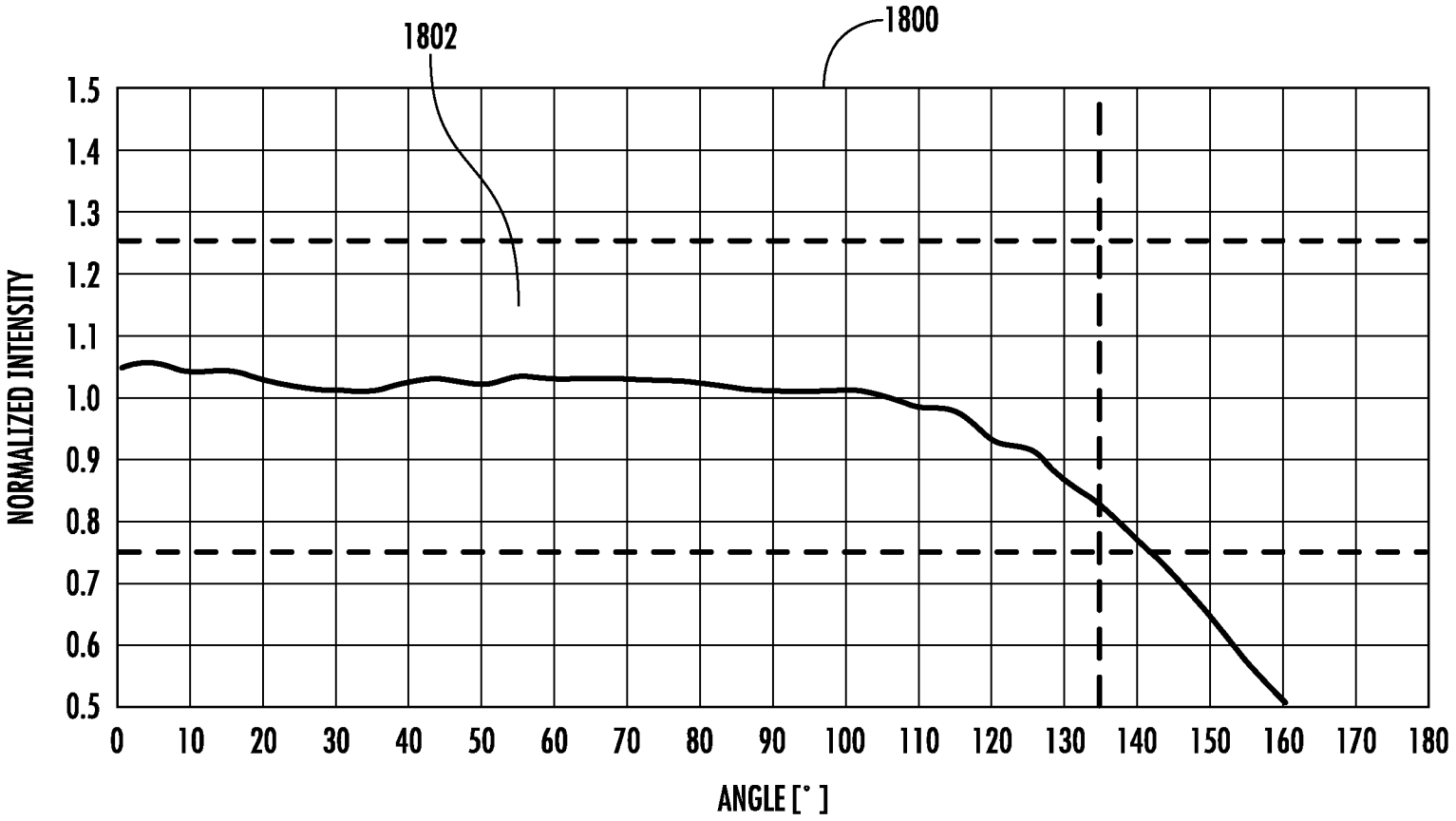
FIG. 18 is an angular emission intensity graph the present invention illustrating the angular emission characteristics of a lamp according to embodiments of the present invention.

FIG. 18 shows a graph 1800 of normalized luminous intensity distribution in the vertical plane that is typical of at least some of the embodiments of the invention described herein. The area 1802 between the horizontal dotted lines represents a targeted distribution of light intensity over an angle of 75% to 125% of the average, where 0° is the angle at the top of the bulb. If the intensity up to 135°, where the vertical dotted line occurs, falls within the horizontal dotted line, we can refer to the light distribution as an "omnidirectional distribution" for purposes of this disclosure.

Although specific embodiments have been illustrated and described herein, those of ordinary skill in the art appreciate that any arrangement, which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A solid-state bulb comprising
a base;
an optically transmissive enclosure on the base;
a plurality of LEDs on a mounting surface of the base; and
a total-internal-reflection (TIR) optic at least partially in an optical path from the plurality of LEDs to a central area of the optically transmissive enclosure, the optic comprising a curved surface to reflect at least a first portion of the light from the plurality of LEDs toward the base and a through hole that extends through the TIR optic that receives a second portion of the light from the plurality of LEDs whereby the solid-state bulb produces an omnidirectional distribution of light.

2. The solid-state bulb of claim 1 wherein the through hole has a diameter from about 5 mm to about 11 mm.

3. The solid-state bulb of claim 1 wherein the TIR optic further comprises a plurality of support legs resting on the base.

4. The solid-state bulb of claim 3 further comprising a diffusive area in or on at least one of the plurality of support legs and/or a side of the TIR optic.

5. The solid-state bulb of claim 1 wherein the TIR optic further comprises a support ring resting on the base.

6. The solid-state bulb of claim 5 further comprising a diffusive area in or on the support ring and/or a side of the TIR optic.

7. The solid-state bulb of claim 1 wherein the TIR optic further comprises a flat bottom surface.

8. The solid-state bulb of claim 7 wherein the plurality of LEDs are distributed beneath the flat bottom surface, circumscribable by a circle from about 15 mm to about 21 mm in diameter.

9. A method of operating a solid-state bulb to produce an omnidirectional distribution of light, the method comprising:
energizing a plurality of LEDs on a mounting surface of a base to emit light;
using a curved surface of a total internal reflection (TIR) optic to reflect a first portion of the light from the plurality of LEDs toward the base; and
allowing at least some of a second portion of the light from the plurality of LEDs into a central area of a light transmissive enclosure through a central through hole that extends through the TIR optic.

10. The method of claim 9 wherein the first portion of the light from the plurality of LEDs enters the TIR optic through a flat bottom surface.

11. The method of claim 10 wherein the plurality of LEDs are distributed between the flat bottom surface and the mounting surface so as to be circumscribable by a circle from about 15 mm to about 21 mm in diameter.

12. The method of claim 11 further comprising diffusing at least some of the light from the LEDs.

13. The method of claim 12 wherein the diffusing of at least some of the light is accomplished by a diffusive area in or on one of a support leg and a side of the TIR optic.

14. The method of claim 12 wherein the diffusing of at least some of the light is accomplished by a diffusive area in or on a support ring.

15. An LED bulb comprising:

a base;

an optically transmissive enclosure on the base defining a longitudinal axis of the lamp;

a plurality of LEDs on a mounting surface of the base; and an optical arrangement at least partially in an optical path from the plurality of LEDs to a central area of the optically transmissive enclosure to reflect at least some light from the plurality of LEDs toward the base;

wherein the optical arrangement further comprises:

a substantially flat mirror to reflect at least a first portion of the light from the plurality of LEDs toward the base, the mirror extending substantially perpendicularly to the longitudinal axis of the lamp, the mirror defining a plurality of through holes that extend through the mirror that receive a second portion of the light from the plurality of LEDs.

16. The LED bulb of claim 15 wherein the LED bulb produces an omnidirectional distribution of light.

17. The LED bulb of claim 16 wherein the optical arrangement comprises a diffusive area adjacent to the mirror.

18. The LED bulb of claim 15 wherein the plurality of through holes have a diameter from about 1 mm to about 5 mm.

19. The LED bulb of claim 15 wherein the mirror is supported on a stanchion.

20. The LED bulb of claim 19 further comprising a diffusive area positioned between the mirror and the plurality of LEDs.

21. A solid-state bulb comprising:

a base;

an optically transmissive enclosure on the base;

a plurality of LEDs positioned to emit light in the enclosure; and an optic at least partially in an optical path from the plurality of LEDs, the optic comprising a total-internal-reflection (TIR) optic including a reflective surface that is positioned to reflect at least a first portion of the light from the plurality of LEDs toward the base, a plurality of support legs comprising a diffusive area resting on the base and at least one through hole that extends through the optic that receives a second portion of the light from the plurality of LEDs that passes through the optic without being reflected by the reflective surface whereby the solid-state bulb produces an omnidirectional distribution of light.

* * * * *